US006484472B2

(12) United States Patent
Chi

(10) Patent No.: US 6,484,472 B2
(45) Date of Patent: Nov. 26, 2002

(54) PROTECTIVE CORNER GUARD

(76) Inventor: Fu-Long Chi, No. 2, Lane 1157, Sec. 1, Li-Ming Rd., Nan-Tun Dist., Taichung City (TW)

( * ) Notice: Subject to any disclaimer, the term of this patent is extended or adjusted under 35 U.S.C. 154(b) by 33 days.

(21) Appl. No.: 09/834,119

(22) Filed: Apr. 12, 2001

(65) Prior Publication Data

US 2001/0037617 A1 Nov. 8, 2001

(51) Int. Cl.[7] ..... E04C 2/38

(52) U.S. Cl. ..... 52/718.02; 52/717.04; 52/288.1; 52/312

(58) Field of Search ..... 52/717.04, 288.1, 52/718.01, 105, 312, 718.02; 108/27

(56) References Cited

U.S. PATENT DOCUMENTS 5,657,955 A * 8/1997 Adams ..... 248/345.1
5,743,064 A * 4/1998 Bennett ..... 52/718.04
5,979,132 A * 11/1999 Margarit ..... 52/312
6,354,049 B1 * 3/2002 Bennett ..... 52/287.1

* cited by examiner

*Primary Examiner*—Carl D. Friedman
*Assistant Examiner*—Naoko Slack
(74) *Attorney, Agent, or Firm*—Ostrolenk, Faber, Gerb & Soffen, LLP

(57) ABSTRACT

A protective corner guard includes a main body formed integrally from an ethylene-vinyl acetate copolymer foam material. The main body has two side walls connected to and intersecting with each other at a predetermined angle. Each of the side walls has an inner surface adapted to face a wall corner, an outer surface opposite to the inner surface, and two opposite end portions, each of which has a recessed section formed in the outer surface and a fastener hole formed in the recessed section. A fastener extends through a respective one of the fastener holes for fastening the main body to the wall corner. Light reflective pieces are received in the recessed sections for covering the fasteners, respectively.

4 Claims, 3 Drawing Sheets

PROTECTIVE CORNER GUARD

BACKGROUND OF THE INVENTION

1. Field of the Invention

The present invention relates to a protective corner guard, more particularly to one which is less susceptible to deformation and which provides an enhanced protective effect.

2. Description of the Related Art

A protective corner guard is commonly used for covering an angled corner of a wall of an upright post so as to protect people or children from being injured by the angled corner. A conventional corner guard is formed by bending a sheet of rubber material, and is fastened to the angled corner by screw fasteners. However, the conventional rubber corner guard is susceptible to deformation and is relatively hard. People can still be hurt by the conventional corner guard in the event of accidental collision.

SUMMARY OF THE INVENTION

Therefore, the main object of the present invention is to provide a protective corner guard that is less susceptible to deformation and that provides an enhanced protective effect.

Accordingly, the protective corner guard of the present invention is adapted to be mounted on and to cover a wall corner, and includes a main body, a plurality of fasteners and a plurality of light reflective pieces.

The main body is formed integrally from an ethylene-vinyl acetate copolymer foam material, and has first and second side walls connected to and intersecting with each other at a predetermined angle. Each of the first and second side walls has opposite end portions, an inner surface adapted to face the wall corner, and an outer surface opposite to the inner surface. Each of the opposite end portions of the first and second side walls has a recessed section formed in the outer surface, and a fastener hole formed in the recessed section. The fasteners extend respectively through the fastener holes in the recessed sections of the first and second side walls, and are adapted to fasten the main body to the wall corner. The light reflective pieces are received in the recessed sections for covering the fasteners.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
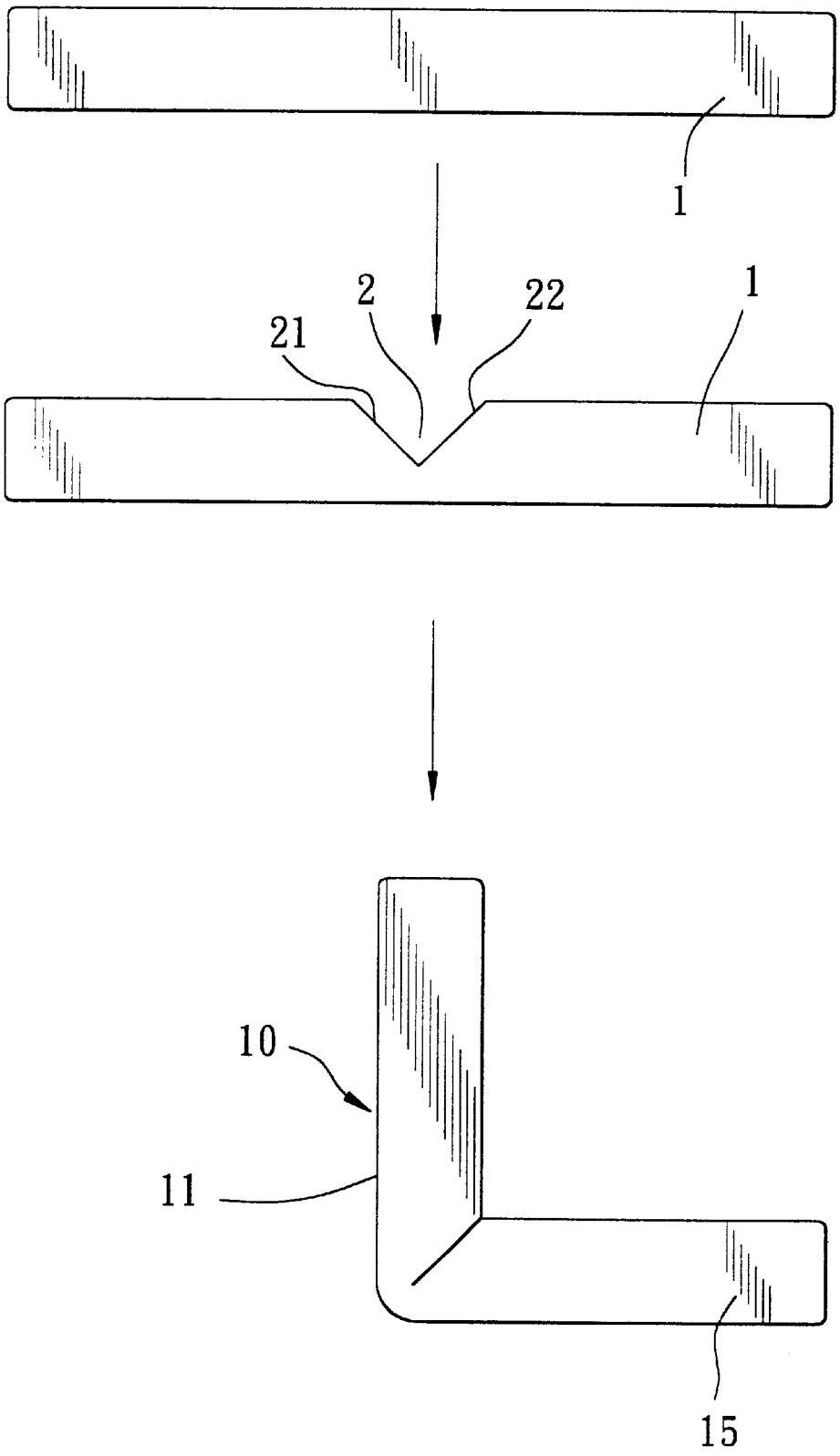
FIG. 1 is a flow diagram illustrating a process for manufacturing a preferred embodiment of the protective corner guard of the present invention.

Referring to FIG. 1, the preferred embodiment of the protective corner guard according to this invention is shown to include a main body 10 formed integrally from an ethylene-vinyl acetate copolymer foam material. The main body 10 is initially formed as a flat board 1 having an elongated groove 2 extending between opposite edges thereof. The elongated groove 2 has a V-shaped cross-section, and is defined by first and second groove-defining walls 21, 22 that intersect with each other at a right angle. The first and second groove-defining walls 21, 22 are then applied with an adhesive, and are attached to each other upon bending the board 1. The board 1 is then placed in an oven for heating and shape-settling. The main body 10 is thus formed to have first and second side walls 11, 15 that cooperate to form the main body 10 into an L-shaped structure.

Figure 2:
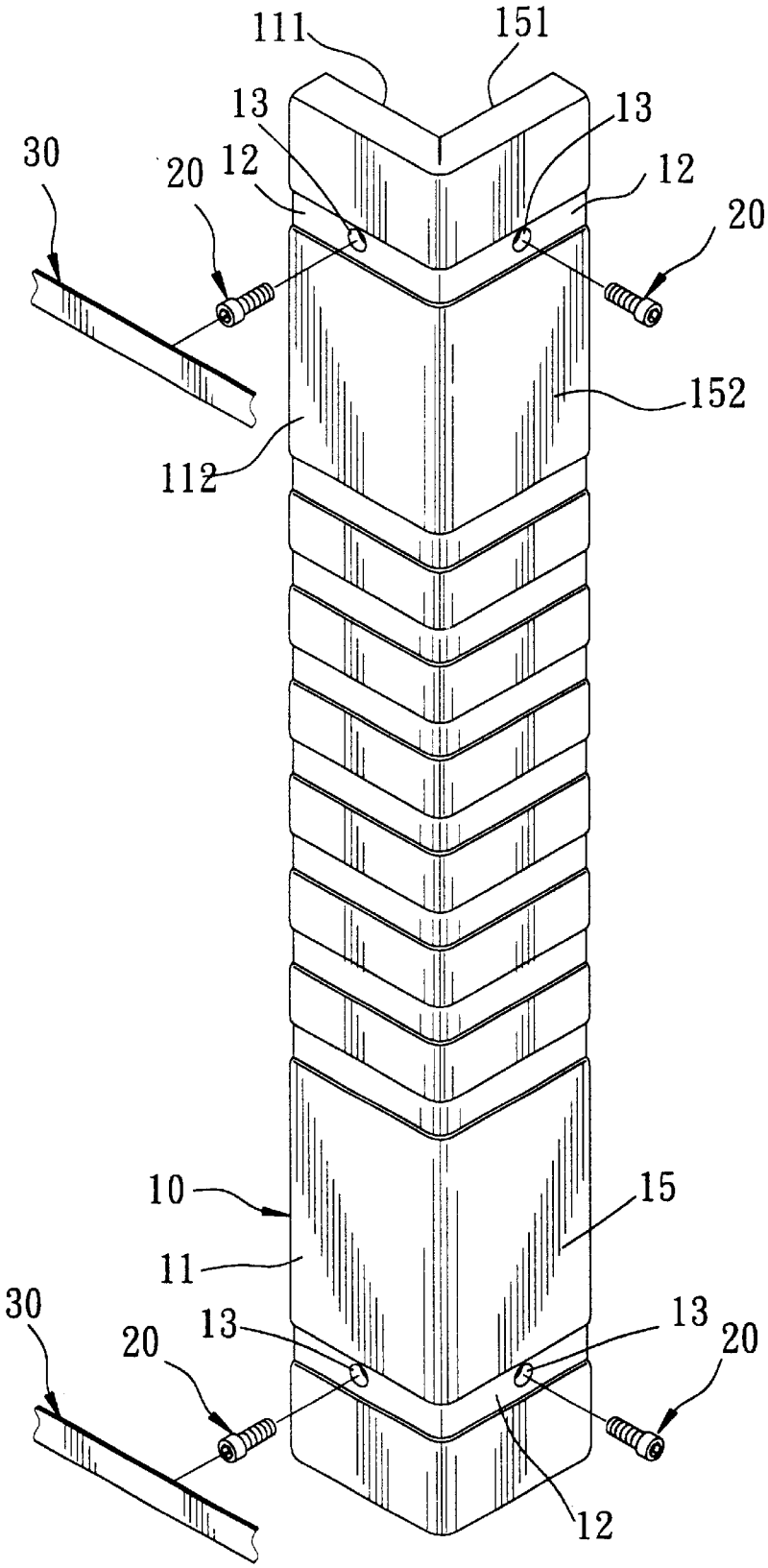
FIG. 2 is an exploded perspective view illustrating the preferred embodiment.
Figure 3:
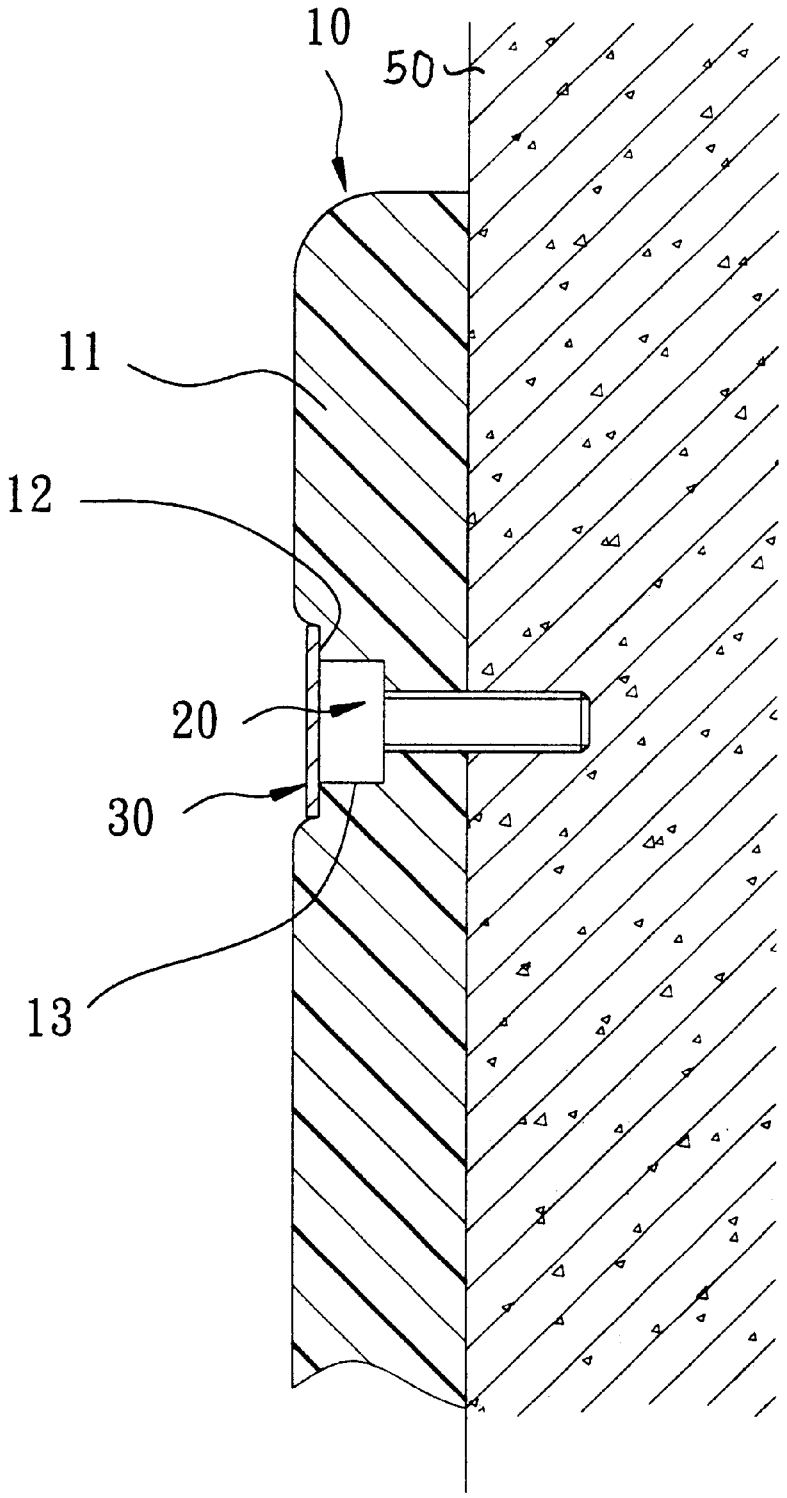
FIG. 3 is a fragmentary sectional view of the preferred embodiment when mounted on a wall surface.

Referring to FIGS. 2 and 3, the protective corner guard 1 of the preferred embodiment is adapted to be attached to an angled wall edge or wall corner 50 for covering the same. The first and second side walls 11, 15 of the main body 10 are connected to and intersect with each other at a right angle in the present embodiment. Each of the first and second side walls 11, 15 has an inner surface 111, 151 adapted to face the wall corner 50, and an outer surface 112, 152 opposite to the inner surface 111, 151. The outer surface 112, 152 of each of the first and second side walls 11, 15 has a plurality of recessed sections 12 that are arranged between upper and lower end portions of the respective side wall 11, 15. Each of the recessed sections 12 on the first side wall 11 is registered and communicated with a respective one of the recessed sections 12 on the second side wall 15. Four distal ones of the recessed sections 12 are formed in the upper and lower end portions of the first and second side walls 11, 15. Each of the distal ones of the recessed sections 12 is formed with a fastener hole 13 to permit extension of a screw fastener 20 therethrough for fastening the respective end portion of the main body 10 to the wall corner 50, as shown in FIG. 3. The fastener hole 13 is formed through the respective side wall 11, 15, and is defined by a stepped hole-defining wall having a wider hole section proximate to the outer wall surface 112, 152 for retaining a head portion of the screw fastener 20, and a narrower hole section proximate to the inner surface 111, 151 for receiving a threaded shank portion of the screw fastener 20. A light reflective piece 30 is received in an adjacent and intercommunicated pair of the distal ones of the recessed sections 12 so as to cover the fasteners 20 and to provide a signaling effect for indicating the presence of the wall corner 50.

Since the main body 10 has a well-settled shape, the main body 10 can be in close contact with the wall corner 50 when the main body 10 is fastened to the latter. Moreover, the main body 10 is resilient and is relatively soft so as to result in an enhanced protective effect.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A protective corner guard adapted to be mounted on and to cover a wall corner, said corner guard comprising:

a main body formed integrally from an ethylene-vinyl acetate copolymer foam material and having first and second side walls connected to and intersecting with each other at a predetermined angle, each of said first and second side walls having opposite end portions, an inner surface adapted to face the wall corner, and an outer surface opposite to said inner surface, each of said opposite end portions of said first and second side wall having a recessed section formed in said outer surface, and a fastener hole formed in said recessed section;

a plurality of fasteners extending respectively through said fastener holes in said recessed sections of said first and second side walls and adapted to fasten said main body to the wall corner; and a plurality of light reflective pieces received in said recessed sections for covering said fasteners.

2. The protective corner guard as claimed in claim 1, wherein said recessed sections in said first side wall are registered and communicated respectively with said recessed sections in said second side wall, each of said light reflective pieces being received in an intercommunicated pair of said recessed sections in said first and second side walls.

3. The protective corner guard as claimed in claim 1, wherein said first and second side walls cooperate to form said main body into an L-shaped structure.

4. The protective corner guard as claimed in claim 1, wherein said main body is formed by a process including the steps of:

forming a board from the ethylene-vinyl acetate copolymer foam material, and forming an elongated groove in the board, said elongated groove having a V-shaped cross-section and extending between opposite edges of said board, said elongated groove being defined by first and second groove-defining walls;

applying an adhesive to said first and second groove-defining walls;

attaching said first and second groove-defining walls to each other; and subjecting said board to a heat treatment.

* * * * *